United States Patent [19]

Tamiya et al.

[11] Patent Number: 4,960,340

[45] Date of Patent: Oct. 2, 1990

[54] IMPLEMENT FOR APPLYING LIQUID

[75] Inventors: Fumiyuki Tamiya, Hashimoto; Nobuaki Kobayashi, Ikoma; Mitsuhiro Fukuoka, Osaka, all of Japan

[73] Assignee: Kabushiki Kaisha SAKURAKUREPASU, Osaka, Japan

[21] Appl. No.: 143,915

[22] Filed: Jan. 13, 1988

[30] Foreign Application Priority Data

| | | | |
|---|---|---|---|
| Jan. 23, 1987 | [JP] | Japan | 62-9104[U] |
| Jan. 25, 1987 | [JP] | Japan | 62-8824[U] |
| Apr. 10, 1987 | [JP] | Japan | 62-5199[U] |
| Apr. 10, 1987 | [JP] | Japan | 62-55200[U] |

[51] Int. Cl.[5] ..... A46B 11/00

[52] U.S. Cl. ..... 401/186; 401/206; 401/273; 401/279; 401/283

[58] Field of Search ..... 401/148, 205, 206, 259, 401/260, 264, 273, 186, 283, 279; 222/213

[56] References Cited

U.S. PATENT DOCUMENTS

| | | | |
|---|---|---|---|
| 548,572 | 10/1895 | Miller | 401/148 |
| 936,186 | 10/1909 | Tellerson | 222/213 |
| 1,315,305 | 9/1919 | Hegland | 401/148 |
| 2,908,423 | 10/1959 | Bross | 222/213 |
| 3,378,330 | 4/1968 | Schwartzman | 401/260 |
| 4,364,684 | 12/1982 | Kohno et al. | 401/273 X |
| 4,461,408 | 7/1984 | Shepard | 401/260 X |
| 4,478,358 | 10/1984 | Lantry | 222/213 |
| 4,564,131 | 1/1986 | Lantry | 222/213 |
| 4,588,319 | 5/1986 | Niemeyer | 401/260 X |

FOREIGN PATENT DOCUMENTS

| | | | |
|---|---|---|---|
| 543117 | 7/1957 | Canada | 222/213 |
| 1020256 | 11/1957 | Fed. Rep. of Germany | 401/65 |
| 55-32784 | 8/1980 | Japan | 401/199 |
| 2148200 | 5/1985 | United Kingdom | 401/260 |

*Primary Examiner*—Steven A. Bratlie
*Attorney, Agent, or Firm*—Jordan and Hamburg

[57] ABSTRACT

An implement for applying liquid includes an elastic container for containing liquid, a head cylinder connected to the elastic container, and a liquid applying member in the head cylinder for applying liquid to a surface, the elastic container having in an opening thereof a valve assembly for supplying and blocking liquid from the elastic container to the head cylinder and pressing portions in the sides thereof, the valve assembly being actuated by pressing the pressing portions. The elastic container includes an oval cylindrical portion having an elliptical cross section consisting of short arcuate portions and long arcuate portions, the long arcuate portions having actuators in the form of inward projected recesses at central portions thereof respectively for acting as pressing portions, the valve assembly including a valve rod carrying a slide member having a tapered surface, the slide member being disposed between the two actuators.

8 Claims, 12 Drawing Sheets

IMPLEMENT FOR APPLYING LIQUID

BACKGROUND OF THE INVENTION AND RELATED ART STATEMENT

The present invention relates to an implement for containing and applying liquid such as correction liquid, manicure paint, liquid adhesive, or ink for marking pens.

A marking pen has been proposed by the applicant, as disclosed in Japanese Examined Utility Model Publication No. 32784/1980.

The marking pen, shown in FIG. 20, includes an ink cylinder 101 having pressing portions 102 on the side wall thereof. When the pressing portions 102 are pressed, a pair of manipulating strips 103 of resilient materials, which extend from the outer periphery of a valve cylinder 100 toward the right in FIG. 20, is bent inward so as to cause a pair of manipulating members 104 joined to terminal ends of their respective manipulating strips 103 to press their taper surfaces 105 against a taper surface of a slide member 107 mounted on the backward end of a valve rod 106, so that the valve rod 106 is moves toward the right in FIG. 20 and a valve opening 108 for supplying a marking head 109 with a liquid of ink is then opened.

However, such a construction has the following disadvantages:

(1) The construction is complicated as the manipulating members 104 are joined to the terminal ends of the manipulating strips 103.

(2) In the prior art, the two manipulating members 104 are respectively joined to the relatively long manipulating strips 103. Accordingly, when the pressing force is accurately applied at the joining portion, i.e., corner portion, the manipulating members assuredly operate. On the other hand, when the pressing force is applied at improper positions, the manipulating strips and members 103, 104 are deformed and consequently, the taper surface 105 does not correspond to the taper surface of the slide member 107 accurately. Therefore, the slide member 107 is wrongly urged to tilt the valve rod 106, which hinders smooth and accurate slide of the valve rod 106.

The problem mentioned in (2) can be eliminated to a slight extent by lessening the deformation with use of short manipulating strips. However, such short manipulating strips make pressing difficult, resulting in uneasy handling.

SUMMARY OF THE INVENTION

The primary object of the present invention is to provide an implement for applying liquid overcoming the above-mentioned problems.

An implement for applying a liquid according to the present invention comprises an elastic container for containing liquid, a head cylinder connected to the elastic container, and a liquid applying member provided in the head cylinder for applying liquid to a surface to be applied, the elastic container having in an opening thereof a valve assembly for supplying and blocking the liquid from the elastic container to the head cylinder and pressing portions in the sides thereof, the valve assembly being actuated by pressing the pressing portions, the elastic container including an oval cylindrical portion having an elliptical cross section consisting of short portions and long arcuate portions, the long arcuate portions having actuators in the form of inward projected recesses at central portions thereof respectively for acting as pressing portions, the valve assembly including a valve rod carrying a slide member having a taper surface, the slide member being disposed between the two actuators.

Accordingly, an implement for applying liquid of the present invention which is simple in construction and in which a valve assembly is operated assuredly and smoothly provides easy handling. Also, an implement for applying liquid of the present invention can be used for various applications by desirably changing a section including a valve assembly and liquid applying portion.

DETAILED DESCRIPTION OF PREFERRED EMBODIMENTS OF THE INVENTION

Preferred embodiments according to the present invention will be described in conjunction with the accompanying drawings.

Figure 1:
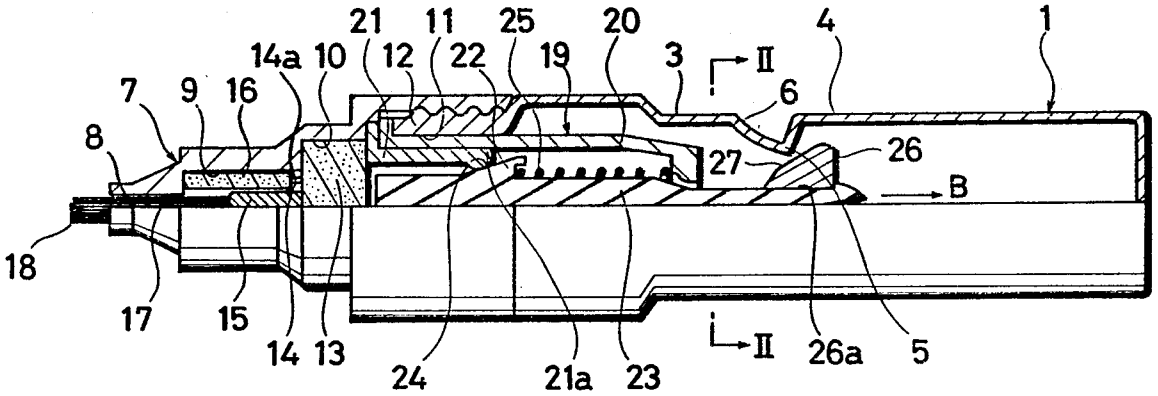
FIG. 1 is a longitudinal half cross-sectional view of a first embodiment of the present invention in which the implement is not put in use.
Figure 2:
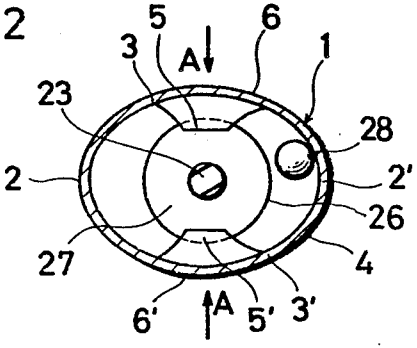
FIG. 2 is a cross-sectional view taken along the line II—II of FIG. 1.

First Embodiment (FIGS. 1 and 2)

A liquid applying implement according to the present invention includes an elastic container 1 for containing liquid such as correction liquid, manicure paint, liquid adhesive, etc. The elastic container 1 is made of resilient material having a property of elasticity, e.g., polyethylene or polypropylene.

The elastic container 1 has a forward half portion in the from of a true cylinder and a backward half portion 4 in the form of an oval having an elliptical cross section, as shown in FIG. 2. The oval portion 4 comprises a pair of opposite short arcuate portions 2, 2' and a pair of opposite ling arcuate portions 3, 3'. The long arcuate portions 3, 3' have at their respective centers actuators 5, 5' which are projected inward and opposite to each other. The long arcuate portions 3, 3' act as pressing portions 6, 6'.

The elastic container 1 is formed, for example, by blow-molding. The oval portion 4 may be oblong or rectangular in longitudinal cross section. Although it is sufficient in the present invention to form the portion into an oval configuration in which the actuators are formed so as to act as pressing portions, the entire construction of the elastic container 1 may be formed with an oval configuration.

A head cylinder 7 is mounted at the forward end of the elastic container 1. The head cylinder 7 has a small-diameter cavity 8, a medium-diameter cavity 9, and a large-diameter cavity 10 and is mounted in threaded engagement with a thread portion 12 arranged on the outer periphery of the opening end 11 of the elastic container 1.

A liquid absorbing member 13 is provided in the large-diameter cavity 10 of the head cylinder 7. The absorbing member 13 is made of resilient and porous absorbent material, e.g. urethane-foam. A pressing member 15 which is smaller in diameter than the medium-diameter cavity 9 is provided in the medium-diameter cavity 9. The pressing member 15 is provided with a flange 14 having a plurality of holes **14*a* for passing liquid. A liquid absorbing tube 16 of absorbent material similar to the material of the absorbing member 13 is provided between the pressing member 15 and the wall of the medium-diameter cavity 9. The flange 14 on the pressing member 15 is movably disposed between the absorbing member 13 and the absorbing tube 16**.

A brush-like liquid applying member 17 is fixed on the pressing member 15 in such a way that the terminal end of the liquid applying member 17 extends forward from the small-diamter cavity 8 to form a liquid applying tip 18. When the liquid applying tip 18 is pressed againt an applying surface, e.g. a paper sheet, the pressing member 15 retracts together with the liquid applying member 17 to compress the absorbing member 13. Upon being compressed, the absorbing member 13 supplies a given amount of liquid to the liquid applying tip 18. When not used, the liquid applying tip 18 is covered by placing a cap (not shown) over the head cylinder 7 to prevent the liquid applying tip 18 from drying.

A valve assembly 19 known in the art is provided in the opening 11 of the elastic container 1. The assembly comprises a valve cylinder 20, a valve seat cylinder 21, a valve rod 23, and a spring 25.

The valve cylinder 20 is fitted through the opening 11. The valve seat cylinder 21 is fitted through the valve cylinder 20 and has a valve seat **21*a* at the backward end thereof. The valve rod 23 has a valve portion 22 of forwardly converging conical shape and is slidably provided along the axis of the valve cylinder 20 and the valve seat cylinder 21. The spring 25 is provided between the end wall of the valve cylinder 20 and the valve portion 22 of the valve rod 23 in such a way that the valve portion 22 comes into contact with the valve seat 21*a* of the valve seat cylinder 21 in the usual state to keep a valve cavity 24** closed.

The valve rod 23 has at its end a slide member 26 of forwardly converging conical shape. The slide member 26 has a conical taper surface 27 and a center bore **26*a*. The slide member 26 is fixedly attached to the valve rod 23 by inserting the rear end portion of the valve rod 23 extending outward of the valve cylinder 20 through the center bore 26*a* utilizing an adhesive or a pressure fitting. The slide member 26 is arranged in such a way that the taper surface 27 comes into contact with the inwardly projected portions of the actuators 5, 5'. It will be understood that the taper surface 27 may be formed into a flat or arcuate shape although a conical shape is adopted in the embodiment. The slide member 26 may also be formed integrally with the valve rod 23. The elastic container 1 accommodates a ball 28** for stirring the liquid.

The operation of this embodiment will be described.

First, the elastic container 1 is filled with a desired liquid to be applied. When filled with a correction liquid, for example, the liquid applying implement can be used as a tool for correcting.

When the liquid applying implement is not put in use, in other words, no external pressure is exterted on the implement, the valve portion 22 rests on the valve seat **21*a* as shown in FIG. 1 and thus, the valve opening 24 remains closed to allow no liquid to flow into the liquid applying tip 18**.

When the pressing portions 6, 6' are pressed in inward directions represented by the arrows A in FIG. 2 with the liquid applying tip 18 being oriented downward, the actuators 5, 5' move inward to press against the taper surface 27 of the slide member 26. Then, the slide member 26 of the slidable valve rod 23 is moved backward owing to the inward movement of the actuators 5, 5' and the valve rod 23 is slid in the B direction resisted by the force of the spring 25. This allows the valve opening 24 to open. Consequently, the liquid flows from the elastic container 1 through the absorbing member 13, the holes **14*a* in the flange 14 and the absorbing tube 16 to the liquid applying tip 18 of the liquid applying member 17**.

When the pressing portions 6, 6' are released after the liquid is fed, the actuators 5, 5' return to their original positions and simultaneously the valve rod 23 is moved to its closed position by the expanding force of the spring 25. Then, the valve opening 24 is closed and the supply of liquid is stopped. Consequently, the liquid can be applied to the applying surface by placing the liquid applying tip 18 against the surface.

When the liquid in the liquid applying tip 18 runs short due to use on the applying surface, the liquid can be applied again by pressing the liquid applying tip 18 against the surface so that the liquid applying member 17 and the pressing member 15 move backward to compress the absorbing member 13 so as to supply a required amount of liquid to the liquid applying tip 18. The applying amount of liquid can be determined by controlling the pressing force of the liquid applying tip 18 against the applying surface. When the liquid in the absorbing member 13 becomes low, the consecutive supply of liquid can be made by pressing the pressing portions 6, 6' of the implement.

As depicted above, this liquid applying implement in which the actuator portions 5, 5' are formed integrally with the long arcuate portions 3, 3' of the oval cylinder 4 and the pressing portions 6, 6' are provided in the long arcuate portions 3, 3' assures easy pressing. Additionally, the actuators 5, 5' which are not liable to deform due to the pressure comes into contact with the taper surface 27 of the slide member 26 without deflection. Accordingly, the valve assembly 19 operates assuredly and smoothly.

Furthermore, the actuators 5, 5' which are recesses formed in the long arcuate portions 3, 3' enables the operator to find the recesses by his fingers with ease. In other words, because this implement gives clear pressing position to the operator, the pressing can be assuredly done.

Although, each of the actuators 5, 5' of the embodiment has an inward end which is linear in cross section and comes to point contact with the taper surface 27 of the slide member 26 as shown in FIG. 2, the inward end may be formed with a convexity in relative to the axial surface of the elastic container 1, or a concavity to correspond to the outside surface of the slide member 26 or a concavity having a greater curvature.

It meay be proper to provide the slide member 26 and the valve portion 22 of the valve rod 23 with a taper converging toward the right in FIG. 1 so that the valve rod 23 can slide leftward (in the opposite direction of the arrow B) when the pressing portions 6, 6' of the container 1 is pressed in order to open the valve opening 24.

Furthermore, a section which extends from the valve assembly 19 to the liquid applying tip 18 may be changed for various applications, for example, by changing the section to that of a marking pen disclosed in the above-mentioned Japanese Examined Utility Model Publication No. 32784/1980.

Figure 3:
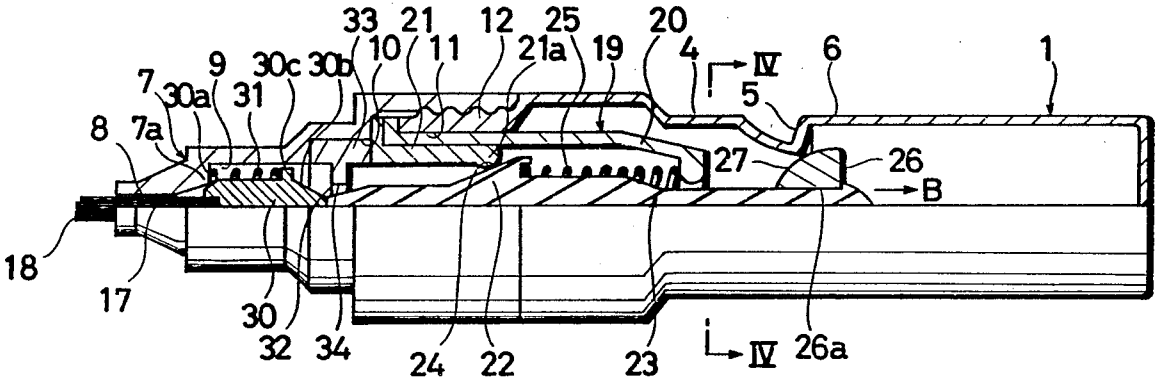
FIG. 3 is a longitudinal half cross-sectional view of a second embodiment of the invention in which the implement is not put in use.
Figure 4:
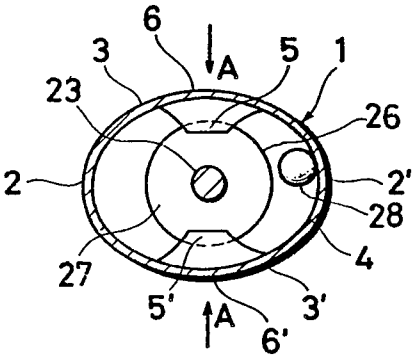
FIG. 4 is a cross-sectional view taken along the line IV—IV of FIG. 3.
Figure 5:
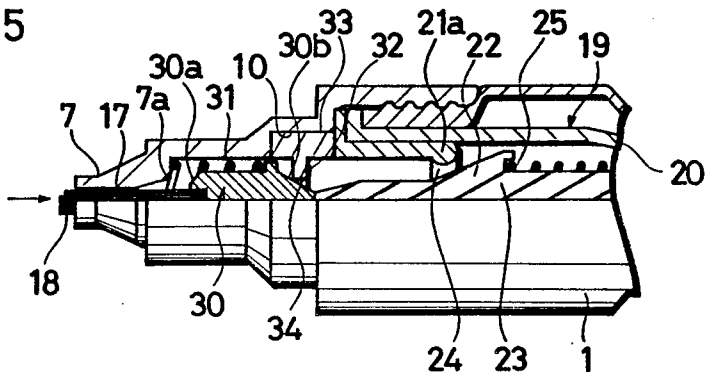
FIG. 5 is a fragmentary half cross-sectional view of the second liquid applying implement in which the implement is put in use.

Second Embodiment (FIGS. 3 to 5)

When a liquid (e.g. correction liquid, manicure paint) having a higher viscosity than high permeable liquid (e.g. ink for marking pens) is used, it is difficult to flow liquid to a pen head.

On the other hand, when the liquid is supplied in an excessive amount by the action of a valve assembly, a liquid applying tip discharges an abrupt flow or a massive drop of liquid due to surface tension when pressing an applying tip against a surface. In the case of a construction in which the flow of liquid is discharged by pressing its body, a larger amount of liquid is discharged as the pressure of an elastic container is increased when pressing.

In view of the above-mentioned fact, the second embodiment is devised which can flow liquid of relatively high viscosity to an apply tip and applying a proper amount of liquid to a surface without discharging abruptly.

As different points from the first embodiment, the second embodiment has a head valve 30 in a head cylinder 7 in place of the liquid absorbing member 13, the pressing member 15, and the liquid absorbing tube 16.

The head valve 30 has conical surfaces **30*a* and 30*b* in the forward and backward ends respectively, an annular flange 30 in the central portion, and a liquid applying member 17 fixedly attached to the forward face. The head valve 30 is pressed in a forward direction by a valve rod 23 in the usual state so that the conical surface 30*a* comes into contact with an annular stepped portion 7*a* of a head cylinder 7 to close a small-diameter cavity 8. It will be noted that the conical surface 30 and the annular stepped portion 7*a* are not required to come in close contact with each other. It is not undesirable that there is a bit clearance between them. A spring 31 is provided between the annular flange 30*c* and the conical portion 7*a* in such a way that the head valve 30 is slidably urged toward the valve rod 23. The expanding force of the spring 31 is less than that of the spring 25 in a valve assembly 19. Accordingly, the valve opening 24 is closed in the usual state. The liquid applying member 17 may be made of porous sponge, felt, a grooved rod, or the like as shown in FIG. 3. Also, the member 17 may be formed of the same material as and made integrally with the head valve 30. The liquid applying member 17** may be formed of material corresponding to application.

A hollow cylinder 33 of resilient material such as polyethylene is provided in a large-diameter cavity 10 of the head cylinder 7. A cut-off wall 32 is formed on the inner surface of the hollow cylinder 33. The cut-off wall 32 is situated between the backward end of the head valve 30 and the valve opening 24 of the valve assembly 19. When the head valve 30 is moved along with the backward movement of the valve rod 23 by pressing pressing portions 6, 6', the conical surface **30*b* of the head valve 30 comes into contact with the cut-off wall 32 of the hollow cylinder 33 to close an opening 34 formed in the cut-off wall 32. According to the present invention, the hollow cylinder 33 may be used as cut-off means by making the inner diameter of the tube 33 smaller than the outer diameter of the flange 30*c* of the head valve 30**.

The operation of the second embodiment will be described.

when this liquid applying implement is not put in use, the valve portion 22 of the valve rod 23 rests on the valve seat **21*a*, as shown in FIG. 3 and the valve opening 24 remains closed to prevent liquid from flowing to the head valve 30**.

When the pressing portions 6, 6' are pressed in the same manner as in the first embodiment, the valve rod 23 slides in the B direction shown in FIG. 3. Then, the valve opening 24 is opened as shown in FIG. 5 and liquid flows to the head valve 30. As the valve rod 23 moves, the head valve 30 in contact with the forward end of the valve rod 23 is slid toward the valve rod 23 by the expanding force of the spring 31. This causes the conical surface **30*b* to come into contact with the cut-off wall 32 and the opening 34 of the cut-off wall 32 is consequently closed. Accordingly, the flow of liquid from the valve opening 24 to the head valve 30** is interrupted, which prevents the abrupt supply of liquid.

When the pressing is released, each member returns backward to its original position shown in FIG. 3 by the resilience of the elastic container 1 and the opening 34 is opened to release the blockage. Then, liquid flows to the liquid applying tip 18 through the medium-diameter cavity 9 to provide the applicable state. When the liquid in the applying tip 18 is consumed, a flow of liquid can be fed from the elastic contaner 1 by pressing the pressing portions 6, 6'.

As depicted above, this liquid applying implement flows liquid when the liquid applying member 17 is retracted to the head cylinder 7 together with the head valve 30 and the valve rod 23 with the pressing portions 6, 6' being pressed. Therefore, liquid of relatively high viscosity can be supplied to the liquid applying tip 18. Additionally, since the conical surface **30*b* comes into contact with the cut-off wall 32 when the head valve 30 is moved, the flow of liquid is blocked and the abrupt supply of liquid is prevented. This allows the liquid applying tip 18 to discharge liquid in a proper amount without discharging an undesirable massive flow of liquid. Also, since the conical surface 30*a* of the head valve 30 comes into contact with the annular stepped portion 7*a* in its return state, as shown in FIG. 3, the liquid in the medium-diameter cavity 9 is prevented from flowing to the liquid applying tip 18** due to the force of gravity and a massive amount of liquid is prevented from being discharged. Accordingly, this implement makes it possible to use a liquid of relatively high viscosity with ease.

It will be noted that the expanding force of the spring 31 may be less than that of the spring 25 urging the valve rod 23 and than the pressure in the elastic container 1 immediately after being pressed. In this case, the opening 34 is closed when the elastic container 1 is pressed. Immediately after the container is pressed, the head valve 30 is retracted resisting against the force of the spring 31 due to the pressure exerted by the pressing. Consequently, the opening 34 is opened to allow liquid to flow. In other words, abrupt flow of liquid to the medium-diameter cavity 9 is prevented due to the fact that the opening 34 is closed during the pressing. Immediately thereafter, the opening 34 is opened to permit liquid to flow at a relatively high speed to the medium-diameter cavity 9. This fact is advantageous for the use of liquid of high viscosity or of relatively low fluidity.

Figure 6:
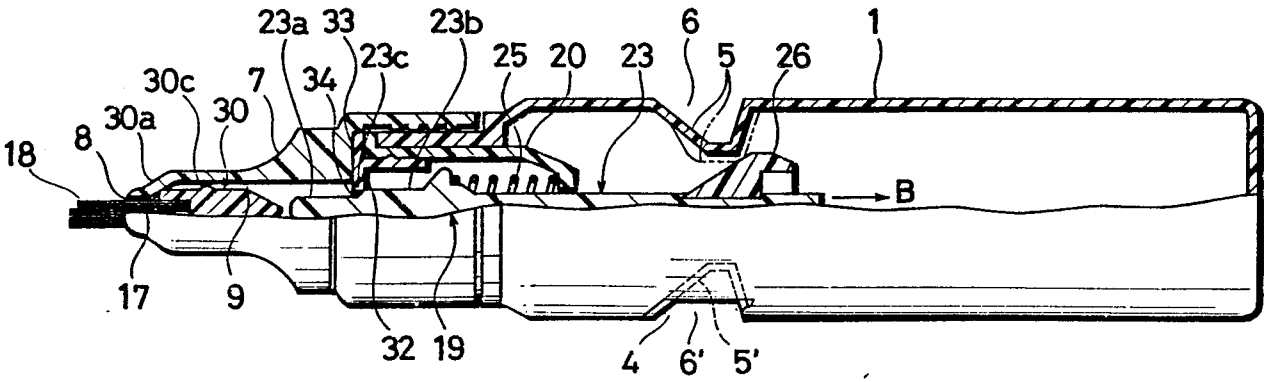
FIG. 6 is a partially cross-sectional side view of a third embodiment of the present invention.
Figure 7:
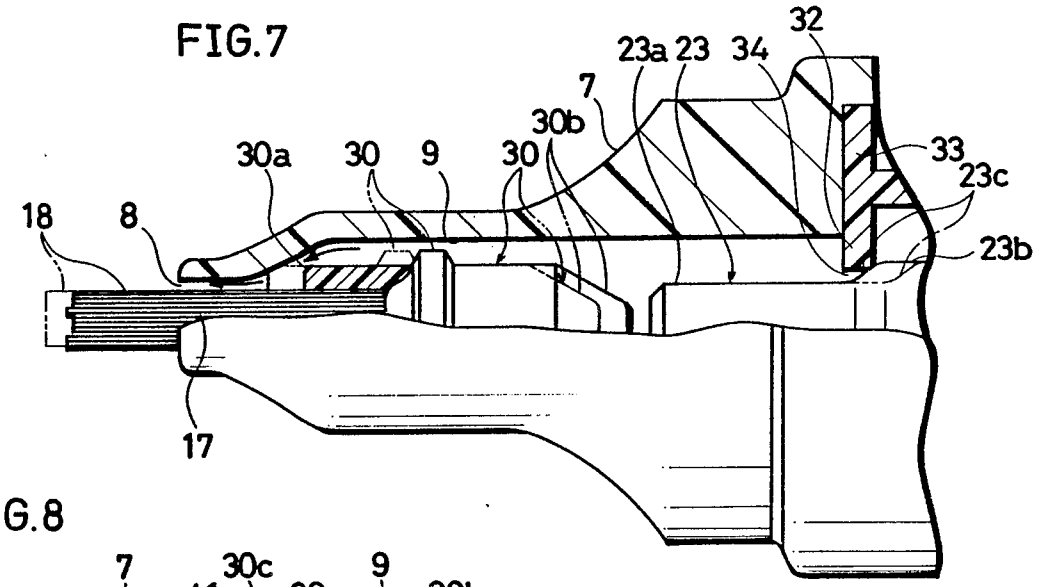
FIG. 7 is a partially cross-sectional side view of the main portion of the third implement.

Third Embodiment (FIGS. 6 and 7)

In the liquid applying implement shown in FIG. 3 or a liquid applying implement disclosed in Japanes Unexamined Utility Model Publication No. 184781/1982, when the implement is not put in use, a liquid applying member 17 is disconnected from the medium-diameter cavity 9 by the head valve 30 so that liquid is prevented from leaking. In such a construction, as the liquid applying member 17 contains a small amount of liquid when starting apply liquid, it will be understood that after the head valve 30 is moved to the right, it takes a considerable time to fill the liquid applying member 17 with liquid of an appropriate amount for use.

Additionally, since liquid is trapped within the head cylinder 7 which is closed tightly, it is difficult to check the flow of liquid to the head cylinder 7. Also, there is a possibility that the pressure in the head cylinder 7 is increased excessively by the flow of liquid from the elastic container 1. Accordingly, there is a likelihood that liquid is discharged for a greatly short time by the excessive pressure when the head valve 30 is opened. It will be seen that this is accelerated by the pressure of the elastic container 1 exerted during the pressing, particularly in the construction in which a flow of liquid is produced by the pressing. Furthermore, in this construction, because the head cylinder 7 is closed tightly, the air in the head cylinder 7 is replced by liquid from the container for a more slow time. Accordingly, there is a likelihood that the valve opening 24 is closed prior to the completion of the air-liquid replacement and the pressed elastic container 1 does not return to its original shape.

In view of the above-mentioned problems, the third embodiment is devised which can eliminate unrequired time at the beginning of operation and check the flow of liquid from outside and prevent liquid from discharging for a short time. Also, this liquid applying implement is suitable for liquid of medium viscosity such as manicure paint, synthetic glue, or the like.

As different points from the second emodiment, the third embodiment is not provided with the spring 31 urging the head valve 30 towards the valve rod 23 but has a head valve 30 axially movable in the head cylinder 7. When a conical surface **30*a* of a head valve 30 comes in contact with the wall of the head cylinder 7, the chamber of the head cylinder 7 is tightly closed. Also, this embodiment has a clearance between an annular flange 30*c* and the inner surface of the head cylinder 7 for flowing liquid, it should be noted that this embodiment does not absolutely require the annular flange 30*c***.

On the other hand, a valve rod 23 has a small-diameter portion **23*a* and a large-diameter portion 23*b* in a head cylinder 7 thereof and a seal portion 23*c* between both portions 23*a* and 23*b*. An opening 34 of a cut-off wall 32 is closed and opened by the seal portion 23*c*. In other words, the opening 34 is closed and opened by the movement of the valve rod 23**.

When the liquid applying implement is not put in use or pressing portions 6, 6' are not pressed, the valve rod 23 is urged forward by a spring 25 and the cut-off wall 32 is closed with the seal portion **23*c* of the valve rod 23. Accordingly, liquid in the elastic container 1 does not flow into the head cylinder 7. In other words, the cylinder head 7 is not filled with liquid. At this time, the head valve 30 receives no great pressure and is movable in the head cylinder 7. A conical surface 30*a* of the head valve 30 is lightly in contact with the inner surface of the head cylinder 7 or is spaced a bit from the inner surface. Consequently, liquid in the head cylinder 7 flows through the clearance between the head valve 30 and the inner surface of the head cylinder 7 to a small-diameter cavity 8** to discharge gradually.

Next, when the pressing portion 6, 6' are pressed, the valve rod 23 moves in the direction represented by the arrow B in FIG. 6 in the same manner as the former embodiment. Consequently, the seal portion **23*c* of the valve rod 23 is moved away from the cut-off wall 32 to open the opening 24. Pressure is applied to liquid in the elastic container 1 by the deformation of the container 1 to flow liquid into the head cylinder 7**.

When the head cylinder 7 is filled with liquid and the pressure in the head cylinder 7 is incresed, the head valve 30 in the head cylinder 7 is moved forward. Then, the head valve 30 moves to a position represented by two-dot chain lines in FIG. 7 and the small-diameter cavity 8 is closed due to the fact that conical surface **30*a* of the valve 30 comes in contact with the inner surface of the head cylinder 7. Since liquid is discharged through the small-diameter cavity 8 under pressure until the small-diameter cavity 8 is closed, the flow of liquid to the head cylinder 7 can be observed. Additionally, the application of liquid can be started without a delay of time since the liquid applying member 17 contains a small amount of liquid. During the application of liquid, the liquid applying member 17 is pressed against a surface to be applied to move the head valve 30 inward of the implement. Consequently, the small-diameter cavity 8 is opened to supply liquid from the head cylinder 7 to the liquid applying member 17 constantly. When liquid in the head cylinder 7 is consumed, liquid is continuously supplied by pressing the pressing portions 6, 6'**.

As depicted above, in this liquid applying implement, no excessive liquid is discharged because the small-diameter cavity 8 is closed when the head valve 30 is moved forward by the pressure of liquid in the head cylinder 7 which is increased due to the flow of liquid from the elastic container 1. Additionally, since a small amount of liquid is constantly supplied through the small-diameter cavity 8 due to that fact that the head valve 30 is movable except the initial time when the liquid is introduced from the elastic container 1, an undesirable time which is required before the application of liquid is considerably reduced, as compared to a liquid applying implement in which when it is not put in use, its small-diameter cavity 8 is closed. Furthermore, the amount of liquid flowed to the head cylinder 7 can be controlled easily by checking of the discharge of liquid from the implement and regulating the pressing force. A large amount of liquid can be prevented during the application of liquid since the pressure in the head cylinder 7 does not exceed due to the fact that the head cylinder 7 is not tightly closed except the initial supply time. Also, since the head cylinder 7 is not tightly closed, air in the head cylinder 7 is smoothly replaced by liquid from the elastic container 1.

In addition, adjustment of the axial movement of the head valve 30 or the distance between the small-diameter cavity 8 and the forward end of the valve rod 23 makes it possible to control the applying amount of liquid from the head cylinder 7 during the application of liquid.

Figure 8:
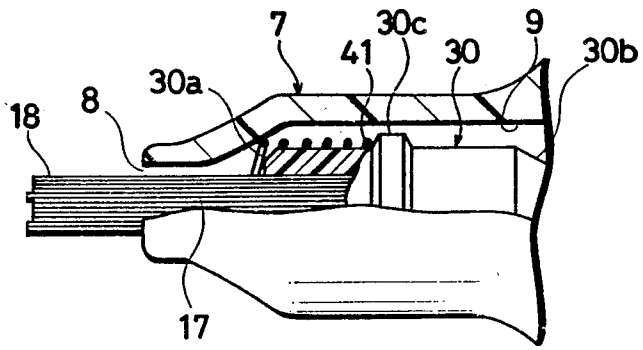
FIG. 8 is a partially cross-sectional side view of the main portion of a fourth embodiment of the present invention.

Fourth Embodiment (FIG. 8)

In the third embodiment, when liquid of high viscosity or of flow fluidity is used, there is a likelihood that the small-diameter cavity 8 is closed with the head valve 30 being urged forward prior to the completion of discharging liquid in the head cylinder 7 through the small-diameter cavity 8. In view of the above-mentioned problem, the fourth embodiment is provided with a spring 41 between the inner surface of the head cylinder 7 and the annular flange **30*c* of the head valve 30 so as to urge the head valve 30 towards the valve rod 23 and forcibly provide a clearance between the head cylinder 7 and the annular sloping portion 30*a***.

The fourth embodiment in which the head valve 30 is not moved forward until the pressure becomes higher than the third embodiment allows an increased amount of liquid to flow to the small-diameter cavity 8 prior to the closing the cavity 8, which enables liquid of high viscosity to use.

Also, the conical surface **30*a* of the head valve 30 may be formed into a rough surface without using the spring 41 so that a clearance is provided between the conical surface 30*a* and the inner surface of the head cylinder 7** in the contact state so as to allow liquid to flow through the clearance.

Consequently, this embodiment can be utilized in applying liquid of high viscosity. Liquid of high viscosity for use with this embodiment are colors, paint, viscous ink, fluidable lip-colors, etc.

Figure 9:
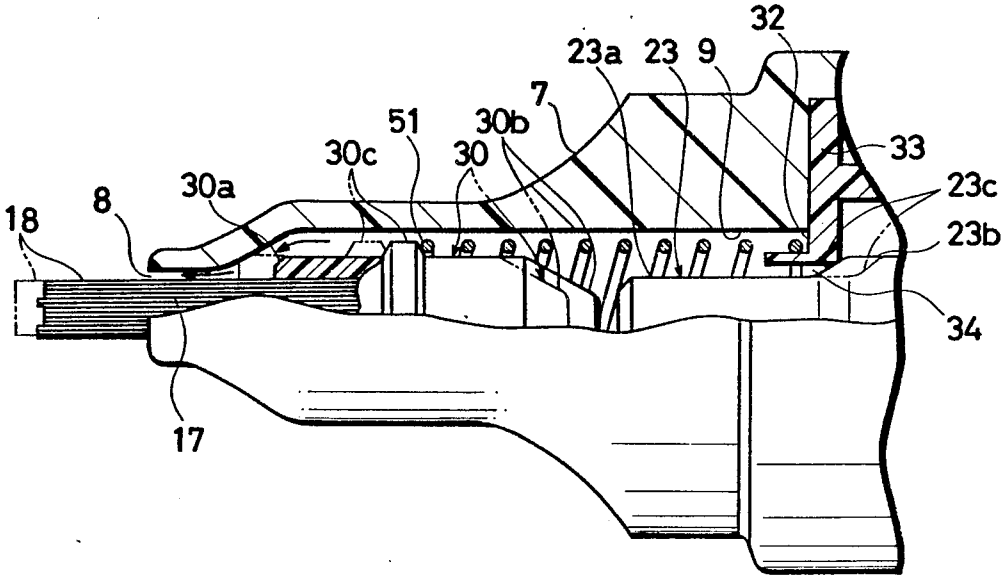
FIG. 9 is a partially cross-sectional side view of the main portion of a fifth embodiment of the present invention.

Fifth Embodiment (FIG. 9)

In the case that the liquid of relatively low viscosity or high fluidity is used for the third embodiment reversely to the fourth embodiment, there is a possibility that an excessive discharge of liquid is discharged due to the fluidity. Therefore, it is desirable that the small-diameter cavity 8 is closed by the head valve 30 soon after the liquid is flowed.

Accordingly, this embodiment is provided with a spring 51 between the annular flange **30*c* of the head valve 30 and a cut-off wall 32. The backward end of the spring 51 is fixedly attached to the cut-off wall 32. In other words, the head valve 30 is supported by the spring 51 and restricted for movement towards the valve rod 23 only. The expanding force of the spring 51** is set at lower than usual writing pressure.

According to this construction, the axial movement of the head valve 30 is restricted, except the time when the liquid applying member 17 is urged by pressure from outside. The clearance constantly provided between the inner surface of the head cylinder 71 and the annular flange **30*c* of the head valve 30 is small. Consequently, the small-diameter cavity 8 is closed for a shorter time after liquid is flowed to the head cylinder 7 than the first embodiment. Accordingly, this embodiment can use liquid of high fluidity. Additionally, since the head valve 30 moves backward against the expanding force of the spring 51 when the liquid applying member 17 is pressed against a surface to be applied, this embodiment can obtain the same flow control range of the liquid applying member 17** as the third embodiment. This embodiment can use liquid of low viscosity such as ink, ink for plastic model marker, ink for paint marker, color liquid for eyeblow, ink for writing pens, etc.

Sixth Embodiment (FIGS. 10 to 15)

The sixth embodiment is devised which can reduce the loss of time prior to the startup of applying of liquid and prevent abrupt discharge of liquid by checking the flow of liquid from outside, similar to the third, fourth, and fifth embodiments.

Figure 10:
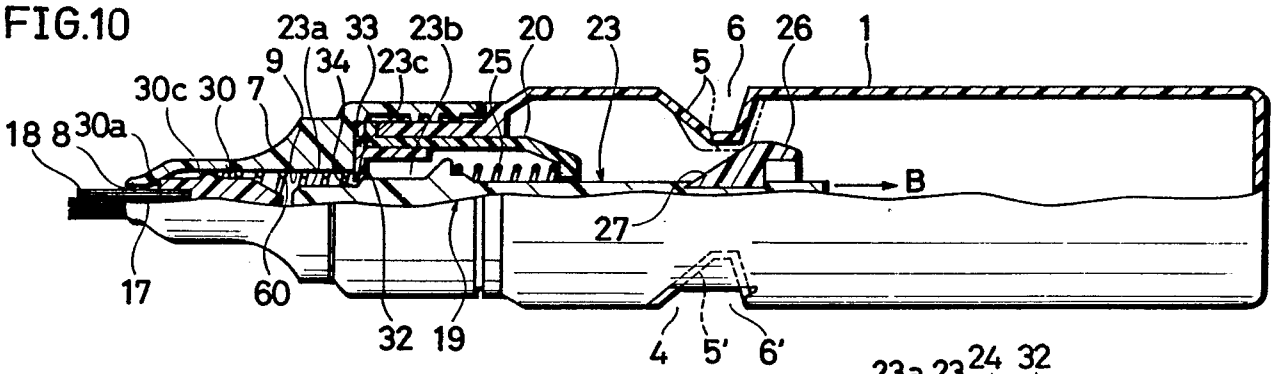
FIG. 10 is a partially cross-sectional side view of a sixth embodiment of the present invention.
Figure 11:
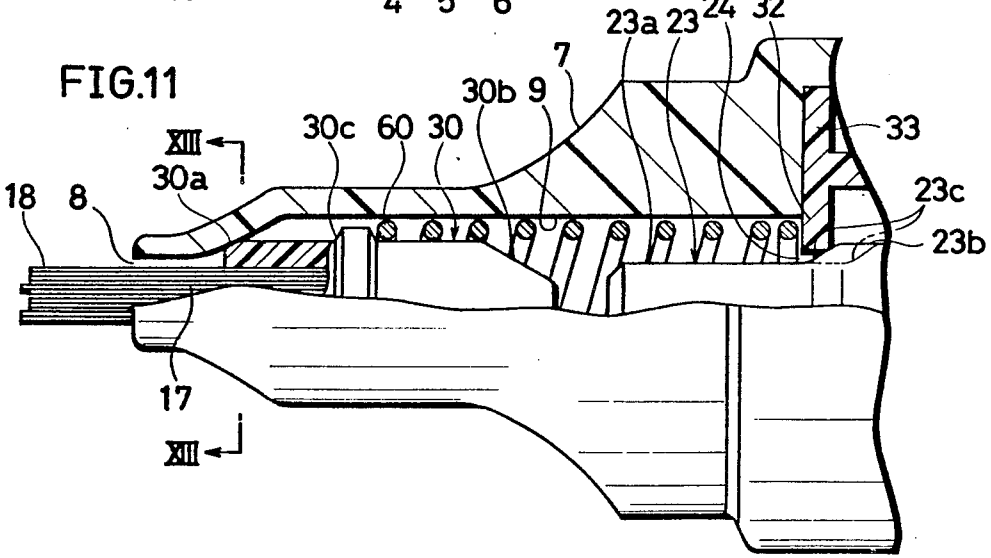
FIG. 11 is a partially cross-sectional side view of the main portion of the sixth implement in which the implement is not put in use.

This embodiment is provided with a spring 60 between the annular flange **30*c* of the head valve 30 and the cut-off wall 32 of the liquid applying implement of the third embodiment, as shown in FIGS. 10 and 11, so as to urge the head valve 30 against the forward inner surface of the head cylinder 7. Accordingly, the conical surface 30*a* of the head valve 30 comes in contact with the inner surface of the head cylinder 7 except the time when an external pressure is applied. The head valve 30 is formed such that the chamber of the head cylinder 7 can be communicated with the liquid applying member 17 by clearance between the conical surface 30*a* and the inner surface of the head cylinder 7** in the contact state.

Figure 13:
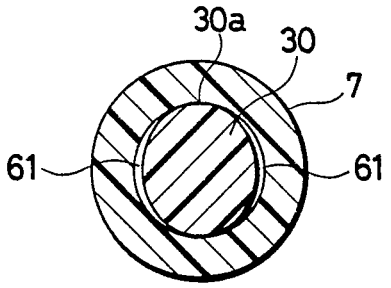
FIG. 13 is a cross-sectional view taken along the line XII—XII of FIG. 11.
Figure 14:
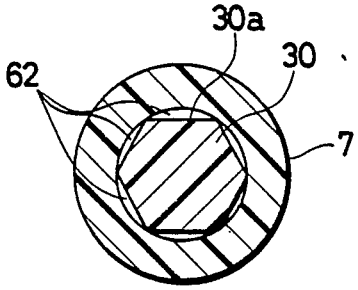
FIG. 14 is a cross-sectional view showing a modification of the sixth implement corresponding to FIG. 13.
Figure 15:
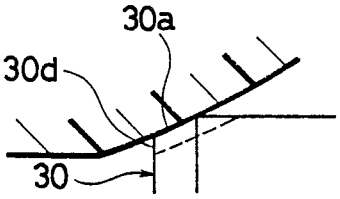
FIG. 15 is an enlarged cross-sectional side view showing the main portion of the modification.

More specifically, the head valve 30 is formed into an elliptical shape in cross section so as to provide spaces 61 between the head valve 30 and the head cylinder 7, as shown in FIG. 13. A modification is possible, as shown in FIG. 14, in which the head valve 30 is formed into a polygon in cross section to give spaces 62. Also, another modification is possible, as shown in FIG. 15, in which a plurality of ribs **30*d* are formed on the conical surface 30*a* to provide passages therebetween. Such spaces or passages may be formed by other modifications, e.g. forming a knurl over the conical surface 30*a***.

In this liquid applying implement, when not used, the valve rod 23 is urged forward by the spring 25 so that the opening 34 is closed by the seal portion 23c of the valve rod 23. Accordingly, no liquid is flowed into the head cylinder 7. Consequently, the cylinder is not filled with liquid.

On the other hand, the head valve 30 is urged forward by the spring 60 so that the conical surface 30a of the head valve 30 is in contact with the inner surface of the head cylinder 7 except the time when the liquid applying member 17 is applied with pressure. Since the spaces 61 are formed between the conical surface 30a and the inner surface of the head cylinder 7, liquid in the head cylinder 7 is able to flow to the applying member 17 from the small-diameter cavity 8 through the spaces 61.

Next, when the pressing portions 6, 6' are pressed, the valve rod 23 moves backward to open the opening 34 and flow liquid into the head cylinder 7 in the same manner as the other embodiment. Consequently, the pressure in the head cylinder 7 is increased. The increased pressure causes a small amount of liquid to flow from the spaces 61 through the small-diameter cavity 8 to the liquid applying member 17. Since the liquid applying member 17 contains a small amount of liquid, it takes a short time to start the application of liquid.

Figure 12:
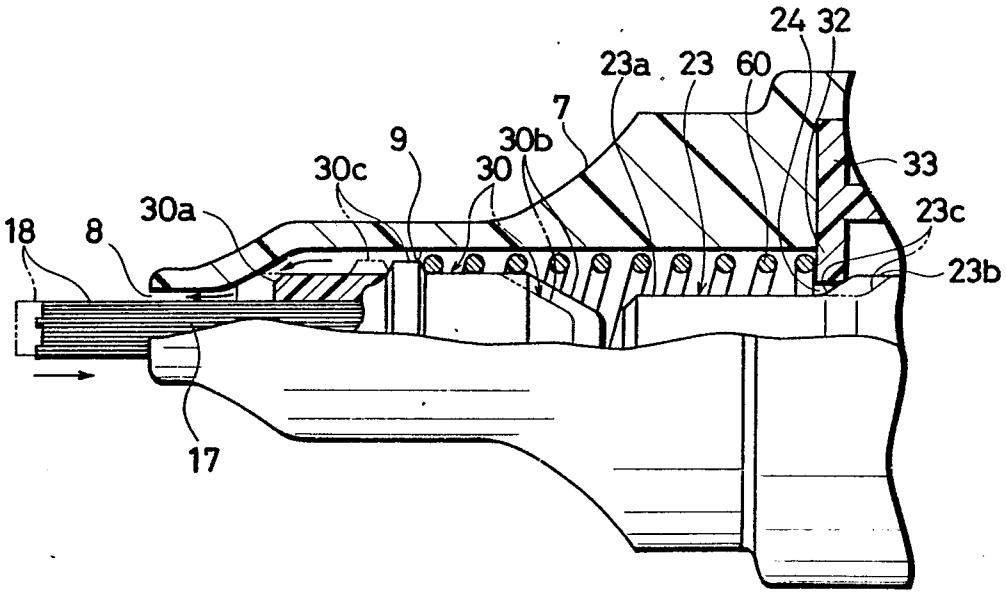
FIG. 12 is a partially cross-sectional side view of the main portion of the six implement in which the implement is put in use.

During the application of liquid, the liquid applying member 17 is pressed against a surface to be applied so as to move the head valve 30 backward against the expanding force of the spring 60, as shown in FIG. 12. Consequently, the small-diameter cavity 8 is opened to flow liquid from the head cylinder 7 to the liquid applying member 17. When liquid in the head cylinder 7 is consumed, the pressing portions 6, 6' are pressed.

As depicted above, this liquid applying implement in which liquid can flow from the clearance between the head valve 30 and the inner surface of the head cylinder 7 even when the head valve and the inner surface are in contact with each other accomplishes the same effect as the third, fourth, and fifth embodiments. When using the liquid of relatively high viscosity, liquid can be forcibly discharged from the spaces 61 by applying an external pressure. Accordingly, the flow of liquid to the head cylinder 7 can be observed from outside.

It is desirable to adjust the expanding force of the spring 60 and the size of the clearance in accordance with the viscosity of liquid to be used. If the viscosity of liquid is relatively low, a large amount of liquid abruptly flows from the spaces 61 due to high fluidity. To eliminate the problem, the flow of liquid through the spaces 61 is controlled by forming the conical surface 30a so as to reduce the size of space 61. Additionally, the expanding force of the spring 60 is increased so as to push the head valve 30 under a reduced pressure and prevent a large amount of liquid from flowing during the application of liquid. When the viscosity of liquid is high, the opposite formation is made.

Figure 16:
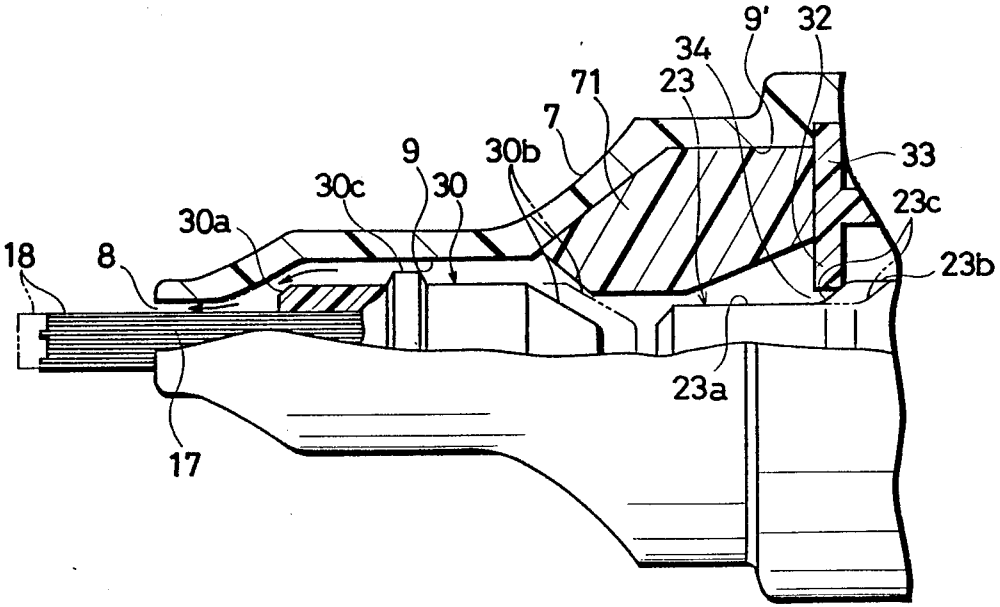
FIG. 16 is a partially cross-sectional side view of the main portion of a seventh embodiment of the present invention.

Seventh Embodiment (FIG. 16)

In the case of the third embodiment, the application of liquid is started after the liquid is flowed into the head cylinder 7 by pressing the pressing portions 6, 6'. However, if the application of liquid is started with the pressing portions 6, 6' being pressed, liquid flows from the elastic container 1 to the liquid applying tip 18 at all time due to the fact that the opening 34 and the small-diameter cavity 8 are both opened. This may result in disadvantage such as massive leakage.

In view of the problem, this embodiment is provided with an intermediate cavity 9' between a hollow cylinder 33 and a medium-diameter cavity 9 in a head cylinder 7 and a restricting member 71 in the cavity 9' as shown in FIG. 16. The member 6' is fixedly attached in the cavity 9' by pressure or adhesion. The restricting member 71 comes into contact with the conical surface 30b of the head valve 30 being pressed backward during the application of liquid. Consequently, the flow of liquid is blocked.

According to the seventh embodiment, the flow of excessive liquid to the liquid applying tip 18 is prevented even when the application of liquid is conducted with the pressing portions 6, 6' being pressed because the restricting member 71 comes into contact with the conical surface 30b of the head valve 30 being pushed back.

Figure 17:
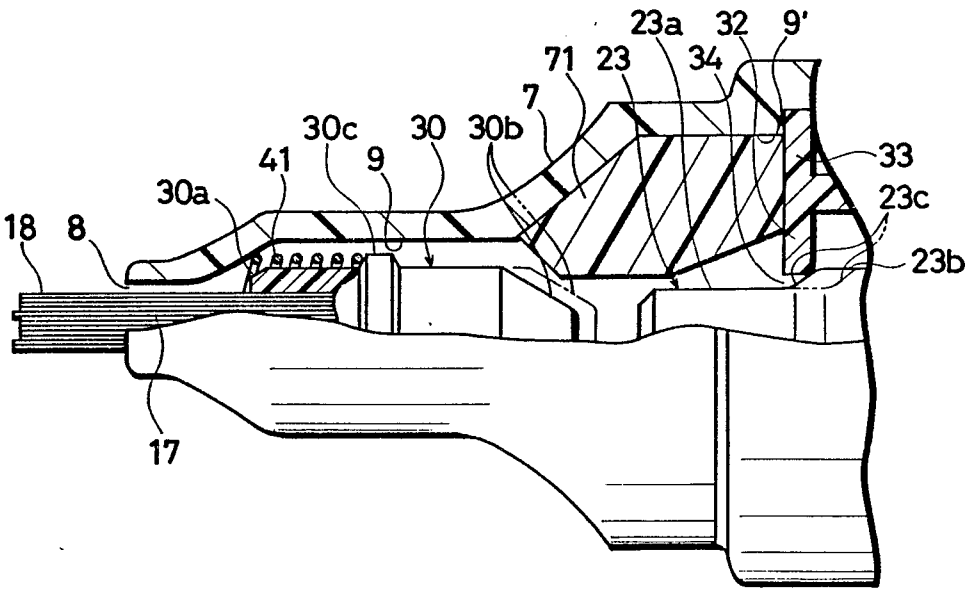
FIG. 17 is a partially cross-sectional side view of the main portion of an eighth embodiment of the present invention.
Figure 18:
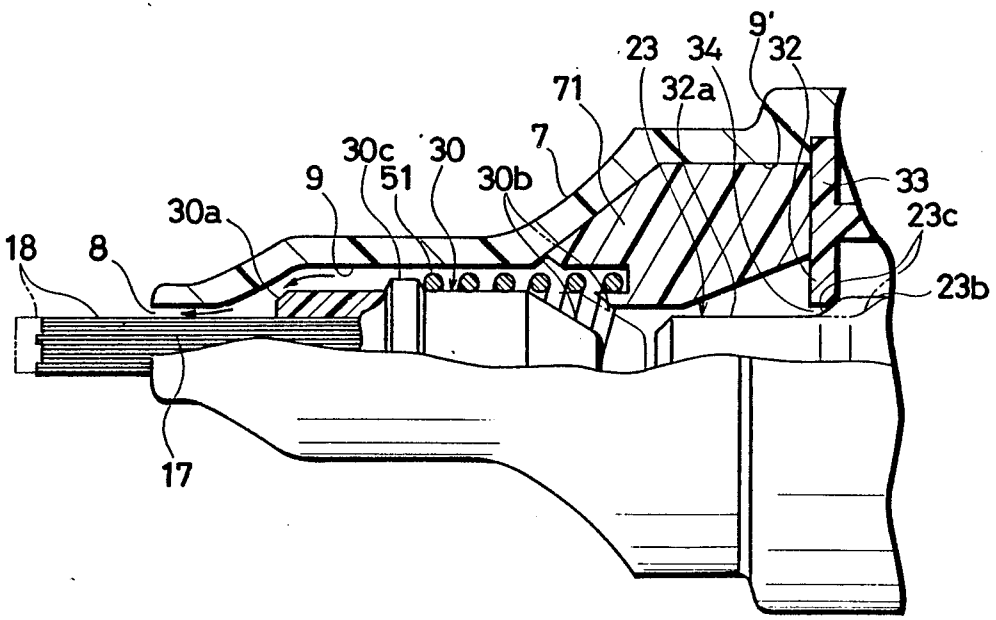
FIG. 18 is a partially cross-sectional side view of the main portion of a ninth embodiment of the present invention.
Figure 19:
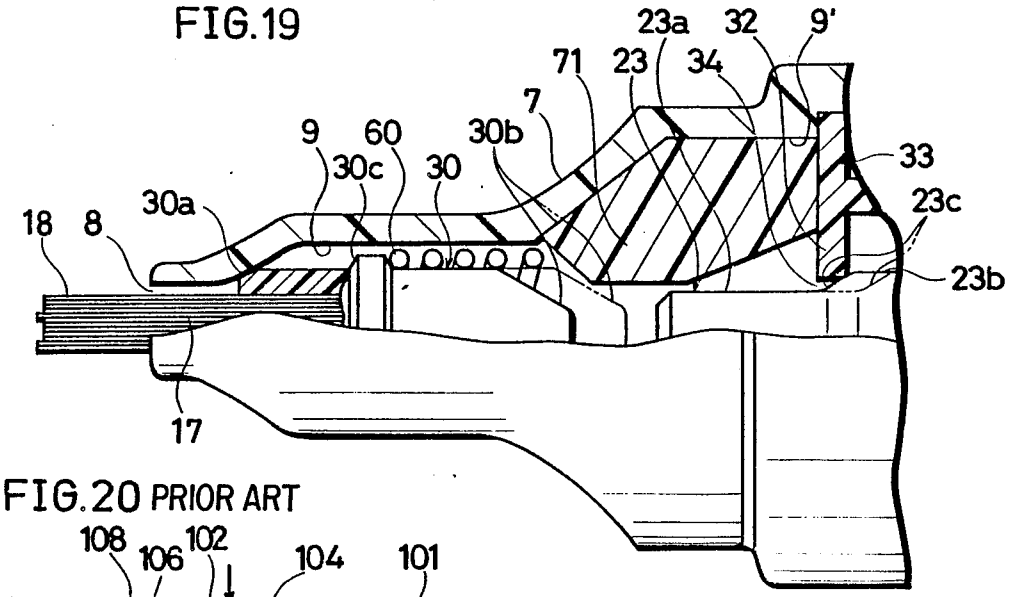
FIG. 19 is a partially cross-sectional side view of the main portion of a tenth embodiment of the present invention.
Figure 20:
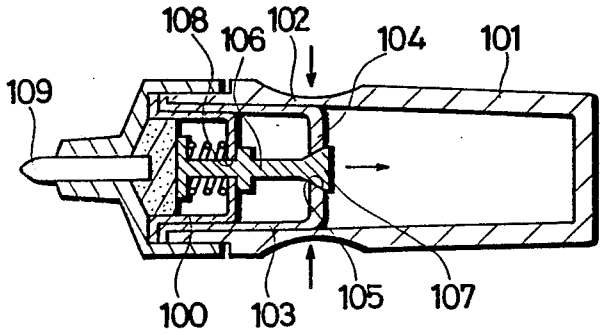
FIG.20 PRIOR ART
FIG. 20 is a longitudinal cross-sectional view of a conventional liquid applying implement.

Furthermore, the eighth, ninth, and tenth embodiments are shown in FIGS. 17, 18, and 19 respectively. These embodiments are constructed by providing a restricting member in the forth, fifth, and sixth embodiments respectively. These embodiments can produce effect as the seventh embodiment. It is desirable to provide springs 51 and 60 for urging between the restricting member 71 and the annular flange 30c of the head valve 30 of the ninth and tenth embodiments respectively as shown in FIGS. 18 and 19. Although these embodiment show a restricting member attached in the head cylinder, it is proper to form a restricting member integrally with the head cylinder.

What we claim is:

1. An implement for applying liquid to a surface comprising a container means containing a liquid, a liquid applicator means for applying said liquid to said surface, a valve housing means disposed between said container means and said applicator means, a valve control means disposed in said valve housing for controlling the flow of said liquid from said container means to said applicator means, actuator means on said container means, said valve control means having an actuatable part juxtaposed to said actuator means such that said actuator means is operable to actuate said actuatable part to thereby control the flow of liquid from said container means to said applicator means, said applicator means having a cavity and an end passage leading from said cavity, compressible liquid absorbing means in said cavity, said applicator means further comprising a sliding means having an outer end which is adapted to engage said surface on which the liquid is to be applied and an inner end engageable with said absorbing means, said sliding means being slidably mounted in said end passage for sliding movement between an extended position and a retracted position, said sliding means being slid from said extended to said retracted position to cause said inner end to compress said absorbing means such that the liquid flows from said absorbing means through said end passage to said outer end of said sliding means.

2. An implement according to claim 1, wherein the diameter of said end passage is less than the diameter of said cavity.

3. An implement according to claim 1, wherein said cavity is designated a first cavity and said absorbing means is designated a first absorbing means, said applicator housing having a second cavity disposed between said first cavity and said end passage, and a second absorbing means in said second cavity.

4. An implement according to claim 3, wherein said second absorbing means has a central axial opening, said sliding means extending through said opening.

5. An implement according to claim 3, wherein said first cavity, said second cavity, and said end passage are arranged in serial axial array, said second cavity having a diameter less than that of said first cavity and greater than that of said end passage.

6. An implement according to claim 1, wherein said outer end of said sliding means comprises an applicator element adapted to engage said surface on which said liquid is applied, said inner end of said sliding means comprising a pressing member which engages and compresses said absorbing means.

7. An implement according to claim 6, wherein said pressing member has a flange having a diameter greater than the diameter of said applicator element, said flange having openings for the passage of said liquid therethrough.

8. An implement according to claim 1, wherein said valve control means comprises a valve rod means in said valve housing means, said valve rod means having said actuatable part, a valve seat means and a spring retainer means on said valve housing means, a spring interposed between said valve rod means and said retainer means for biasing said valve rod means in one direction to a seated position in which said valve rod means is seated on said valve seat means, said acturator means upon being manually actuated being operable to engage said actuatable part and to move said valve rod means in another direction opposite to said one direction to thereby unseat said valve rod means off of said valve seat means and thereby provide for flow of said liquid from said container means past said valve seat means.

* * * * *